US009809760B2

(12) United States Patent
Rosenbaum et al.

(10) Patent No.: US 9,809,760 B2
(45) Date of Patent: Nov. 7, 2017

(54) METHOD FOR PRODUCING A BASE OIL HAVING HIGH WEIGHT PERCENT TOTAL MOLECULES WITH CYCLOPARAFFINIC FUNCTIONALITY AND LOW WEIGHT PERCENT MOLECULES WITH MULTICYCLOPARAFFINIC FUNCTIONALITY

(75) Inventors: John M. Rosenbaum, Richmond, CA (US); Nancy J. Bertrand, Lafayette, CA (US); Scott C. Deskin, Alameda, CA (US); Kamala Krishna, Danville, CA (US); Stephen J. Miller, San Francisco, CA (US); Susan M. Abernathy, Hercules, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1099 days.

(21) Appl. No.: 12/493,048

(22) Filed: Jun. 26, 2009

(65) Prior Publication Data

US 2009/0321308 A1 Dec. 31, 2009

Related U.S. Application Data

(60) Division of application No. 11/438,108, filed on May 19, 2006, now Pat. No. 7,763,161, which is a continuation-in-part of application No. 10/744,389, filed on Dec. 23, 2003, now Pat. No. 7,083,713, and a continuation-in-part of application No. 10/744,870, filed on Dec. 23, 2003, now Pat. No. 7,282,134, and a continuation-in-part of application No. 10/743,932, filed on Dec. 23, 2003, now Pat. No. 7,195,706.

(51) Int. Cl.

| | |
|---|---|
| ***C10M 177/00*** | (2006.01) |
| ***C10G 45/64*** | (2006.01) |
| ***C10G 2/00*** | (2006.01) |
| ***C10G 65/04*** | (2006.01) |

(52) U.S. Cl.

CPC ..... *C10G 45/64* (2013.01); *C10G 2/32* (2013.01); *C10G 65/043* (2013.01); *C10G 2400/10* (2013.01); *Y10S 208/95* (2013.01)

(58) Field of Classification Search

CPC ..... C10G 2400/10; C10G 2300/1022
USPC ..... 208/27
See application file for complete search history.

(56) References Cited

U.S. PATENT DOCUMENTS

| | | | | |
|---|---|---|---|---|
| 3,852,207 | A | 12/1974 | Stangeland et al. | |
| 5,082,986 | A | 1/1992 | Miller | |
| 5,135,638 | A | 8/1992 | Miller | |
| 5,246,566 | A | 9/1993 | Miller | |
| 5,282,958 | A | 2/1994 | Santilli et al. | |
| 6,503,956 | B2 | 1/2003 | Maleksadeh | |
| 6,562,230 | B1 * | 5/2003 | O'Rear | C10G 2/30 208/18 |
| 2003/0088133 | A1 * | 5/2003 | O'Rear | 585/323 |
| 2004/0077505 | A1 * | 4/2004 | Daniel et al. | 508/110 |
| 2004/0108248 | A1 | 6/2004 | Cody et al. | |
| 2004/0108249 | A1 | 6/2004 | Cody et al. | |
| 2005/0133409 | A1 | 6/2005 | Abernathy et al. | |

FOREIGN PATENT DOCUMENTS

| | | | | |
|---|---|---|---|---|
| EP | 0 776 959 | A2 | 6/1997 | |
| EP | 0 668 342 | B1 | 8/1999 | |
| EP | 1 114 127 | B1 | 8/2005 | |
| EP | 1 114 124 | B1 | 2/2006 | |
| GB | WO 02064711 | A1 * | 8/2002 | C10G 2/30 |
| WO | WO 99/20720 | | 4/1999 | |
| WO | WO 00/14179 | | 3/2000 | |
| WO | WO 00/14183 | | 3/2000 | |
| WO | WO 00/14187 | | 3/2000 | |
| WO | WO 01/57166 | A1 | 8/2001 | |
| WO | WO 02/064710 | A2 | 8/2002 | |
| WO | WO 02/064711 | A1 | 8/2002 | |
| WO | WO 02064711 | A1 * | 8/2002 | |
| WO | WO 02/070636 | A1 | 9/2002 | |
| WO | WO 2004/033606 | A1 | 4/2004 | |

OTHER PUBLICATIONS

"Product Brochure of Shell MDS (Malaysia):Sdn Bhd" dated May 1995.

Miller, S.J., "New molecular sieve process for lube dewaxing by wax isomerization," Microporous Materials 2, 1194, 439-449, Elsveier.

* cited by examiner

*Primary Examiner* — Ellen McAvoy
*Assistant Examiner* — Ming Cheung Po
(74) *Attorney, Agent, or Firm* — E. Joseph Gess; Terrence M. Flaherty; Mark L. Warzel

(57) ABSTRACT

A method for producing a base oil having a high ratio of weight percent molecules with monocycloparaffinic functionality to weight percent molecules with multicycloparaffinic functionality by hydroisomerization dewaxing a selected Fischer-Tropsch wax under hydroisomerization conditions including a hydrogen to feed ratio from about 712.4 to about 3562 liter $H_2$/liter oil.

19 Claims, No Drawings

METHOD FOR PRODUCING A BASE OIL HAVING HIGH WEIGHT PERCENT TOTAL MOLECULES WITH CYCLOPARAFFINIC FUNCTIONALITY AND LOW WEIGHT PERCENT MOLECULES WITH MULTICYCLOPARAFFINIC FUNCTIONALITY

RELATED APPLICATIONS

This application is a Divisional of U.S. application Ser. No. 11/438,108, filed May 19, 2009, which is a Continuation-in-Part of co-pending U.S. application Ser. No. 10/744,389, filed Dec. 23, 2003; Ser. No. 10/744,870, filed Dec. 23, 2003, and Ser. No. 10/743,932, filed on Dec. 23, 2003, herein incorporated in their entireties by reference. It is related to a co-filed application titled "LUBRICATING BASE OIL MANUFACTURING PLANT FOR PRODUCING BASE OILS HAVING DESIRED CYCLOPARAFFINIC FUNCTIONALITY," also fully incorporated herein.

FIELD OF THE INVENTION

This invention is directed to methods for producing lubricating base oils with a high weight percent of molecules with cycloparaffinic functionality and a low weight percent of molecules with multicycloparaffinic functionality from a Fischer-Tropsch derived wax.

BACKGROUND OF THE INVENTION

Finished lubricants and greases used for various applications, including automobiles, diesel engines, natural gas engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Highly saturated lubricating base oils in the prior art have either had very low levels of cycloparaffins; or when cycloparaffins were present, a significant amount of the cycloparaffins were multicycloparaffins. A certain amount of cycloparaffins are desired in lubricating base oils to provide additive solubility and elastomer compatibility. Multicycloparaffins are less desired than monocycloparaffins, because they decrease viscosity index, lower oxidation stability, and increase Noack volatility.

Examples of highly saturated lubricating base oils having very low levels of cycloparaffins are polyalphaolefins and base oils made from Fischer-Tropsch processes such as described in EP 1114124, EP 1114127, EP 1114131, EP 776959, EP 668342, and EP 1029029. Lubricating base oils in the prior art with high cycloparaffins made from Fischer-Tropsch wax have been described in WO 02/064710. The examples of the base oils in WO 02/064710 had very low pour points and the ratio of monocycloparaffins to multicycloparaffins was less than 15. The viscosity indexes of the lubricating base oils in WO 02/064710 were below 140. The Noack volatilities were between 6 and 14 weight percent. The lubricating base oils in WO02/064710 were heavily dewaxed to achieve low pour points, which would produce reduced yields compared to oils that were not as heavily dewaxed.

The wax feed used to make the base oils in WO 02/064710 had a weight ratio of compounds having at least 60 or more carbon atoms and compounds having at least 30 carbon atoms greater than 0.20. These wax feeds are not as plentiful as feeds with lower weight ratios of compounds having at least 60 or more carbon atoms and compounds having at least 30 carbon atoms. The process in WO 02/064710 required an initial hydrocracking/hydroisomerizing of the wax feed, followed by a substantial pour reducing step. Lubricating base oil yield losses occurred at each of these two steps. To demonstrate this, in example 1 of WO 02/064710 the conversion of compounds boiling above 370° C. to compounds boiling below 370° C. was 55 wt % in the hydrocracking/hydroisomerization step alone. The subsequent pour reducing step would reduce the yield of products boiling above 370° C. further. Compounds boiling below 370° C. (700° F.) are typically not recovered as lubricating base oils due to their low viscosity. Because of the yield losses due to high conversions the process requires feeds with a high ratio of compounds having at least 60 or more carbon atoms and compounds having at least 30 carbon atoms.

Due to their high saturates content and low levels of cycloparaffins, lubricating base oils made from most Fischer-Tropsch processes or polyalphaolefins may exhibit poor additive solubility. Additives used to make finished lubricants typically have polar functionality; therefore, they may be insoluble or only slightly soluble in the lubricating base oil. To address the problem of poor additive solubility in highly saturated lubricating base oils with low levels of cycloparaffins, various co-solvents, such as synthetic esters, are currently used. However, these synthetic esters are very expensive, and thus, the blends of the lubricating base oils containing synthetic esters, which have acceptable additive solubility, are also expensive. The high price of these blends limits the current use of highly saturated lubricating base oils with low levels of cycloparaffins to specialized and small markets.

It has been taught in US Publication 20030088133 that blends of lubricating base oils composed of 1) alkylated cycloparaffins with 2) highly paraffinic Fischer-Tropsch derived lubricating base oils improves the additive solubility of the highly paraffinic Fischer-Tropsch derived lubricating base oils. The lubricating base oils composed of alkylated cycloparaffins used in the blends of this application are very likely to also contain high levels of aromatics (greater than 30 weight percent), such that the resulting blends with Fischer-Tropsch derived lubricating base oils will contain a weight percent of all molecules with at least one aromatic function greater than 0.30. The high level of aromatics will cause reduced viscosity index and oxidation stability.

What is desired are lubricating base oils with very low amounts of aromatics, high amounts of monocycloparaffins, and little or no multicycloparaffins, that have a moderately low pour point such that they may be produced in high yield and provide good additive solubility and elastomer compatibility. Base oils with these qualities that also have good oxidation stability, high viscosity index, low Noack volatility, and good low temperature properties are also desired. The present invention provides these lubricating base oils.

What is desired is a process to make lubricating base oils with the desired properties detailed above that is not limited to wax feeds having a weight ratio of compounds having at least 60 or more carbon atoms and compounds having at least 30 carbon atoms of at least 0.2. What is also desired is a process for making lubricating base oils with the desired properties that may be accomplished with a single hydroisomerization dewaxing step that provides lower conversion of products boiling above 370° C. (700° F.+) to products boiling below 370° C. (700° F.−), and thus produces higher yields of lubricating base oil.

SUMMARY OF THE INVENTION

We have invented a process for manufacturing a lubricating base oil, comprising:

dewaxing a substantially paraffinic wax feed by hydroisomerization dewaxing using a shape selective intermediate pore size molecular sieve under hydroisomerization conditions including a hydrogen to feed ratio from about 712.4 to about 3562 liter $H_2$/liter oil (about 4 to about 20 MSCF/bbl), whereby a lubricating base oil is produced having:

i. a total weight percent of molecules with cycloparaffinic functionality greater than 10; and ii. a ratio of weight percent molecules with monocycloparaffinic functionality to weight percent molecules with multicycloparaffinic functionality greater than 15.

We have also invented a method for producing a base oil having greater than 10 weight percent total molecules with cycloparaffinic functionality and less than 0.5 weight percent of molecules with multicycloparaffinic functionality, comprising:

b. selecting a Fischer-Tropsch derived wax having a weight ratio of molecules having at least 60 or more carbon atoms and molecules having at least 30 carbon atoms less than 0.18, c. hydroisomerization dewaxing the Fischer-Tropsch derived wax under conditions including a hydrogen to feed ratio from about 712.4 to about 3562 liter $H_2$/liter feed (about 4 to about 20 MSCF/bbl).

Additionally we have invented a lubricating base oil manufacturing plant, comprising:

d. a means for hydroisomerization dewaxing a Fischer-Tropsch wax at a hydrogen to feed ratio from about 712.4 to about 3562 liter $H_2$/liter feed (about 4 to about 20 MSCF/bbl); and e. a means for hydrofinishing the hydroisomerized Fischer-Tropsch wax; wherein the base oil manufacturing plant produces one or more base oils from the Fischer-Tropsch wax having:

i. greater than 10 weight percent total molecules with cycloparaffinic functionality, and ii. less than 0.5 weight percent of molecules with multicycloparaffinic functionality.

DETAILED DESCRIPTION OF THE INVENTION

The terms "Fischer-Tropsch derived" or "FT derived" means that the product, fraction, or feed originates from or is produced at some stage by a Fischer-Tropsch process. The feedstock for the Fischer-Tropsch process may come from a wide variety of hydrocarbonaceous resources, including natural gas, coal, shale oil, petroleum, municipal waste, derivatives of these, and combinations thereof.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes possess a very high viscosity index, normally in the range of from about 140 to 200, depending on the oil content and the starting material from which the slack wax was prepared. Therefore, slack waxes are suitable for the preparation of base oils having a very high viscosity index.

The waxy feed useful in this invention preferably has less than 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into base oil. Accordingly, Fischer-Tropsch wax represents an excellent feed for preparing high quality base oils according to the process of the invention. Fischer-Tropsch wax is normally solid at room temperature and, consequently, displays poor low temperature properties, such as pour point and cloud point. However, following hydroisomerization of the wax, Fischer-Tropsch derived base oils having excellent low temperature properties may be prepared. A general description of suitable hydroisomerization dewaxing processes may be found in U.S. Pat. Nos. 5,135,638 and 5,282,958; and US Publication 20050133409, incorporated herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are more preferred. Preferably the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the base oil. Preferred hydroisomerizing conditions useful in the current invention include temperatures of 260 degrees C. to about 413 degrees C. (500 to about 775 degrees F.), a total pressure of 15 to 3000 psig, and a hydrogen to feed ratio from about 2 to 30 MSCF/bbl, preferably from about 4 to 20 MSCF/bbl, more preferably from about 4.5 or 5 to about 10 MSCF/bbl, most preferably from about 5 to about 8 MSCF/bbl. Generally, hydrogen will be separated from the product and recycled to the isomerization zone. Note that a feed rate of 10 MSCF/bbl is equivalent to 1781 liter $H_2$/liter feed.

Optionally, the base oil produced by hydroisomerization dewaxing may be hydrofinished. The hydrofinishing may occur in one or more steps, either before or after fractionating of the base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, incorporated herein. The hydrofinishing step may be needed to reduce the weight percent olefins in the base oil to less than 10, preferably less than 5, more preferably less than 1, and most preferably less than 0.5. The hydrofinishing step may also be needed to reduce the weight percent aromatics to less than 0.1, preferably less than 0.05, more preferably less than 0.02, and most preferably less than 0.01.

The base oil is fractionated into different viscosity grades of base oil. In the context of this disclosure "different viscosity grades of base oil" is defined as two or more base oils differing in kinematic viscosity at 100 degrees C. from each other by at least 1.0 cSt. Kinematic viscosity is measured using ASTM D 445-04. Fractionating is done using a vacuum distillation unit to yield cuts with pre-selected boiling ranges.

The base oil fractions will typically have a pour point less than zero degrees C. Preferably the pour point will be less than −10 degrees C. Additionally, in some embodiments the pour point of the base oil fraction will have a ratio of pour point, in degrees C., to the kinematic viscosity at 100 degrees C., in cSt, greater than a Base Oil Pour Factor, where the Base Oil Pour Factor is defined by the equation: Base Oil Pour Factor=7.35×Ln(Kinematic Viscosity at 100° C.)−18. Pour point is measured by ASTM D 5950-02.

The base oil fractions have measurable quantities of unsaturated molecules measured by FIMS. In a preferred embodiment the hydroisomerization dewaxing and fractionating conditions in the process of this invention are tailored to produce one or more selected fractions of base oil having greater than 10 weight percent total molecules with cycloparaffinic functionality, preferably greater than 20, greater than 35, or greater than 40; and a viscosity index greater than 150. The one or more selected fractions of base oils will usually have less than 70 weight percent total molecules with cycloparaffinic functionality. Preferably the one or more selected fractions of base oil will additionally have a ratio of molecules with monocycloparaffinic functionality to molecules with multicycloparaffinic functionality greater than 15. In preferred embodiments the base oil has a ratio of molecules with monocycloparaffinic functionality to molecules with multicycloparaffinic functionality greater than 20, or greater than 50. In preferred embodiments the base oil may contain no molecules with multicycloparaffinic functionality, such that the ratio of molecules with monocycloparaffinic functionality to molecules with multicycloparaffinic functionality is greater than 100.

In preferred embodiments, the lubricant base oil fractions useful in this invention have a viscosity index greater than an amount defined by the equation: VI=28×Ln(Kinematic Viscosity at 100° C.)+95. In more preferred embodiments, lubricant base oil fractions useful in this invention have a viscosity index greater than an amount defined by the equation: VI=28×Ln(Kinematic Viscosity at 100° C.)+105.

The presence of predominantly cycloparaffinic molecules with monocycloparaffinic functionality in the base oil fractions of this invention provides excellent oxidation stability, low Noack volatility, as well as desired additive solubility and elastomer compatibility. The base oil fractions have a weight percent olefins less than 10, preferably less than 5, more preferably less than 1, and most preferably less than 0.5. The base oil fractions preferably have a weight percent aromatics less than 0.1, more preferably less than 0.05, and most preferably less than 0.02.

The lubricating base oils of this invention, unlike polyalphaolefins (PAOs) and many other synthetic lubricating base oils, contain hydrocarbon molecules having consecutive numbers of carbon atoms. This is readily determined by gas chromatography, where the lubricant base oil fractions boil over a broad boiling range and do not have sharp peaks separated by more than 1 carbon number. In other words, the lubricating base oil fractions have chromatographic peaks at each carbon number across their boiling range.

In preferred embodiments, where the olefin and aromatics contents are significantly low in the lubricant base oil fraction of the lubricating oil, the Oxidator BN of the selected base oil fraction will be greater than 25 hours, preferably greater than 35 hours, more preferably greater than 40 or even 41 hours. The Oxidator BN of the selected base oil fraction will typically be less than 60 hours. Oxidator BN is a convenient way to measure the oxidation stability of base oils. The Oxidator BN test is described by Stangeland et al. in U.S. Pat. No. 3,852,207. The Oxidator BN test measures the resistance to oxidation by means of a Domte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of O2 by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability.

OLOA is an acronym for Oronite Lubricating Oil Additive®, which is a registered trademark of Chevron Oronite.

Base Oil Distillation:

The separation of Fischer-Tropsch derived fractions and petroleum derived fractions into various fractions having characteristic boiling ranges is generally accomplished by either atmospheric or vacuum distillation or by a combination of atmospheric and vacuum distillation. Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures thermal cracking of the hydrocarbons may take place leading to fouling of the equipment and to lower yields of the heavier cuts. Vacuum distillation is typically used to separate the higher boiling material, such as the lubricating base oil fractions, into different boiling range cuts. Fractionating the lubricating base oil into different boiling range cuts enables the lubricating base oil manufacturing plant to produce more than one grade, or viscosity, of lubricating base oil.

Specific Analytical Test Methods:

Pour points were measured by ASTM D 5950-02.

Wt % Olefins:

The Wt % Olefins in the base oils of this invention is determined by proton-NMR by the following steps, A-D:

A. Prepare a solution of 5-10% of the test hydrocarbon in deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.

C. Measure the integral intensities between:
6.0-4.5 ppm (olefin)
2.2-1.9 ppm (allylic)
1.9-0.5 ppm (saturate)

D. Using the molecular weight of the test substance determined by ASTM D 2503, calculate:
1. The average molecular formula of the saturated hydrocarbons
2. The average molecular formula of the olefins
3. The total integral intensity (=sum of all integral intensities)
4. The integral intensity per sample hydrogen (=total integral/number of hydrogens in formula)
5. The number of olefin hydrogens (=olefin integrav-integral per hydrogen)
6. The number of double bonds (=olefin hydrogen times hydrogens in olefin formula/2)
7. The wt % olefins by proton NMR=100 times the number of double bonds times the number of hydrogens in a typical olefin molecule divided by the number of hydrogens in a typical test substance molecule.

The wt % olefins by proton NMR calculation procedure, D, works best when the % olefins result is low, less than about 15 weight percent. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV:

The method used to measure low levels of molecules with at least one aromatic function in the lubricant base oils of this invention uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated Base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the π-electrons in the aromatic ring. Since few unsubstituted-aromabc compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Molecular Composition by FIMS:

The lubricant base oils of this invention were characterized by Field Ionization Mass Spectroscopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the base oil to be tested in a glass capillary tube. The capillary tube was placed at the tip of a solids probe for a mass spectrometer, and the probe was heated from about 40 to 50° C. up to 500 or 600° C. at a rate between 50° C. and 100° C. per minute in a mass spectrometer operating at about $10^{-6}$ torr. The mass spectrometer was scanned from m/z 40 to m/z 1000 at a rate of 5 seconds per decade.

The mass spectrometers used were a VG 70VSE or a Micromass Time of Flight. Response factors for all compound types were assumed to be 1.0, such that weight percent was determined from area percent. The acquired mass spectra were summed to generate one "averaged" spectrum.

The lubricant base oils of this inventon were characterized by FIMS into alkanes and molecules with different numbers of unsaturations. The molecules with different numbers of unsaturations may be comprised of cycloparaffins, olefins, and aromatics. If aromatics were present in significant amounts in the lubricant base oil they would be identified in the FIMS analysis as 4-unsaturations. When olefins were present in significant amounts in the lubricant base oil they would be identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality in the lubricant base oils of this invention. Note that if the aromatics content was not measured, it was assumed to be less than 0.1 wt % and not included in the calculation for total weight percent of molecules with cycloparaffinic functionality.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl) cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

The total weight percent of molecules with cycloparaffinic functionality is the sum of the weight percent of molecules with monocyclopraffinic functionality and the weight percent of molecules with multicycloparaffinic functionality.

Lubricating Base Oil Manufacturing Plant

Traditionally, lubricating base oil manufacturing plants were defined as either integrated or non-integrated. Integrated plants were linked to primary crude oil refineries and were fed with vacuum distillate by pipeline. Non-integrated plants purchased vacuum distillate on the open market or bought atmospheric residues and performed their own vacuum distillation. Often times they performed vacuum distillation on purchased crude oil.

The lubricating base oil manufacturing plants of this invention are not integrated with primary crude oil refineries in the traditional manner, but rather are integrated with plants that have a means to produce substantially paraffinic wax feed having less than about 30 ppm total combined nitrogen and sulfur, less than about 1 weight percent oxygen, greater than about 75 mass percent normal paraffin, less than 10 weight percent oil, a weight ratio of compounds having at least 60 or more carbon atoms and compounds having at least 30 carbon atoms less than 0.18, and a T90 boiling point between 660° F. and 1200° F. Examples of plants producing this type of wax feed are Fischer-Tropsch synthesis plants and plants capable of producing very highly refined slack waxes or pure n-paraffins.

The lubricating base oil manufacturing plants of this invention also have a means for hydroisomerization dewaxing using a shape selective intermediate pore size molecular sieve comprising a noble metal hydrogenation component, to produce an isomerized oil; and a means for hydrofinishing the isomerized oil to produce lubricating base oils having:

i. a weight percent aromatics less than 0.30;
ii. a weight percent total cycloparaffins greater than 10; and
iii. a ratio of monocycloparaffins to multicycloparaffins greater than 15.

EXAMPLES

The following examples are included to further clarify the invention but are not to be construed as limitations on the scope of the invention.

Fischer-Tropsch Wax

Two commercial samples of hydrotreated Fischer-Tropsch wax made using a Fe-based Fischer-Tropsch synthesis catalyst (WAXA and WAXB) and three samples of hydrotreated Fischer-Tropsch wax made using a Co-based Fischer-Tropsch catalyst (WAXC, WAXD, and WAXE) were analyzed and found to have the properties shown in Table I.

TABLE 1

| Fischer-Tropsch Wax | | | | | |
|---|---|---|---|---|---|
| | Fischer-Tropsch Catalyst | | | | |
| | Fe-Based | Fe-Based | Co-Based | Co-Based | Co-Based |
| | Sample ID | | | | |
| | WAXA | WAXB | WAXC | WAXD | WAXE |
| Sulfur, ppm | | | 7, <2 | <6 | 2 |
| Nitrogen, ppm | 2, 4, 4, 1, 4, 7 | | 12, 19 | 6, 5 | 1.3 |
| Oxygen by Neutron Activation, Wt % | 0.15 | | 0.69 | 0.59 | 0.11 |
| GC N-Paraffin Analysis | | | | | |
| Total N Paraffin, Wt % | 92.15 | | 83.72 | 84.47 | |
| Avg. Carbon Number | 41.6 | | 30.7 | 27.3 | |
| Avg. Molecular Weight | 585.4 | | 432.5 | 384.9 | |
| D6352 SIMDIST TBP (Wt %) ° F. | | | | | |
| T0.5 | 784 | 10 | 129 | 515 | 450 |
| T5 | 853 | 131 | 568 | 597 | 571 |
| T10 | 875 | 181 | 625 | 639 | 621 |
| T20 | 914 | 251 | 674 | 689 | 683 |
| T30 | 941 | 309 | 717 | 714 | 713 |
| T40 | 968 | 377 | 756 | 751 | 752 |
| T50 | 995 | 437 | 792 | 774 | 788 |
| T60 | 1013 | 497 | 827 | 807 | 823 |
| T70 | 1031 | 553 | 873 | 839 | 868 |
| T80 | 1051 | 611 | 914 | 870 | 911 |

TABLE 1-continued

| Fischer-Tropsch Wax | | | | | |
|---|---|---|---|---|---|
| | Fischer-Tropsch Catalyst | | | | |
| | Fe-Based | Fe-Based | Co-Based | Co-Based | Co-Based |
| | Sample ID | | | | |
| | WAXA | WAXB | WAXC | WAXD | WAXE |
| T90 | 1081 | 674 | 965 | 911 | 970 |
| T95 | 1107 | 707 | 1005 | 935 | 1003 |
| T99.5 | 1133 | 744 | 1090 | 978 | 1067 |
| T90-T10, ° C. | 97 | 256 | 171 | 133 | 176 |
| Wt % C30+ | 96.9 | 0.00 | 40.86 | 34.69 | 39.78 |
| Wt % C60+ | 0.55 | 0.00 | 0.00 | 0.00 | 0.00 |
| C60+/C30+ | 0.01 | 0.00 | 0.00 | 0.00 | 0.00 |

The Fischer-Tropsch wax feeds were hydroisomerized over a Pt/SSZ-32 catalyst or Pt/SAPO-11 catalyst on an alumina binder. Run conditions were between 652 and 695° F. (344 and 368° C.), 0.6 to 1.0 LHSV, 300 psig or 1000 psig reactor pressure, and a once-through hydrogen to feed ratio of between 6 and 7 MSCF/bbl. For the majority of the samples the reactor effluent passed directly to a second reactor, also at 1000 psig, which contained a Pt/Pd on silica-alumina hydrofinishing catalyst. Conditions in that reactor were a temperature of 450° F. and LHSV of 1.0. Those samples which were not hydrofinished are indicated in the tables of properties that follow.

The products boiling above 650° F. were fractionated by atmospheric or vacuum distillation to produce distillate fractions of different viscosity grades. Test data on specific distillate fractions useful as lubricating base oils of this invention, and comparison samples, are shown in the following examples.

Lubricating Base Oils

Example 1, Example 2, and Comparative Example 3

Three lubricating base oils with kinematic viscosities below 3.0 cSt at 100° C. were prepared by hydroisomerization dewaxing Fischer-Tropsch wax and fractionating the isomerized oil into different distillate fractions. The properties of these samples are shown in Table II.

TABLE II

| Properties | Example 1 | Example 2 | Comparative Example 3 |
|---|---|---|---|
| Wax Feed | WAXB | WAXB | WAXD |
| Hydroisomerization Temp, ° F. | 681 | 681 | 671 |
| Hydroisomerization Dewaxing Catalyst | Pt/SAPO-11 | Pt/SAPO-11 | Pt/SAPO-11 |
| Reactor Pressure, psig | 1000 | 1000 | 1000 |
| Viscosity at 100° C., cSt | 2.981 | 2.598 | 2.297 |
| Viscosity Index | 127 | 124 | 124 |
| Aromatics, wt % | 0.0128 | 0.0107 | Not tested |
| FIMS, Wt % of Molecules | | | |
| Paraffins | 89.2 | 91.1 | 91.3 |
| Monocycloparaffins | 10.8 | 8.9 | 8.0 |
| Multicycloparaffins | 0.0 | 0.0 | 0.7 |
| Total | 100.0 | 100.0 | 100.0 |
| API Gravity | 43.4 | 44.1 | 44.69 |
| Pour Point, ° C. | −27 | −32 | −33 |
| Cloud Point, ° C. | −18 | −22 | −7 |

TABLE II-continued

| Properties | Example 1 | Example 2 | Comparative Example 3 |
|---|---|---|---|
| Ratio of Mono/Multicycloparaffins | >100 | >100 | 11.4 |
| Ratio of Pour Point/Vis100 | −9.1 | −12.3 | −14.4 |
| Base Oil Pour Factor | −9.97 | −10.98 | −11.89 |
| Aniline Point, D 611, ° F. | 236.5 | 226.3 | |
| Noack Volatility, Wt % | 32.48 | 49.18 | |
| CCS Viscosity @−35° C., cP | <900 | <900 | <900 |

Example 1 and Example 2 have low weight percents of all molecules with at least one aromatic function, high weight percents of all molecules with at least one cycloparaffin function, and a very high ratio of weight percent of molecules containing monocycloparaffins and weight percent of molecules containing mulucycloparaffins. Note that Example 1 does not have greater than 10 weight percent of all molecules with at least one cycloparaffin function, but it does have a weight percent of all molecules with at least one cycloparaffin function greater than the kinematic viscosity at 100° C. multiplied by three. Example 1 also has a high ratio of pour point to kinematic viscosity at 100° C., meeting the properties of a preferred lubricating base oil of this invention. In addition the aniline points of Examples 1 and 2 fall below the line given by: 36×Ln(Kinematic Viscosity at 100° C.)+200. Comparative Example 3 has a slightly lower weight percent of all molecules with at least one cycloparaffin function. Comparative Example 3 also has a less desirable ratio of weight percent of molecules containing monocycloparaffins to weight percent of molecules containing multicycloparaffins, and a less preferred lower ratio of pour point to kinematic viscosity. These examples demonstrate that a low viscosity lubricating base oil of this invention, with a kinematic viscosity at 100° C. between 2 and about 3.3 cSt, may have less than 10 weight percent of all molecules with at least one cycloparaffin function, but a weight percent of all molecules with at least one cycloparaffin function greater than 3 times the kinematic viscosity at 100° C.

Example 4, Example 5, Example 6, and Example 7

Four lubricating base oils with kinematic viscosities between 4.0 and 5.0 cSt at 100° C. were prepared by hydroisomerization dewaxing Fischer-Tropsch wax and fractionating the isomerized oil into different distillate fractions. The properties of these samples are shown in Table III.

TABLE III

| Properties | Example 4 | Example 5 | Example 6 | Example 7 |
|---|---|---|---|---|
| Wax Feed | WAXD | WAXE | WAXC | WAXA |
| Hydroisomerization Temp, ° F. | 673 | 652 | 700 | 682 |
| Hydroisomerization Dewaxing Catalyst | Pt/SAPO-11 | Pt/SAPO-11 | Pt/SAPO-11 | Pt/SAPO-11 |
| Reactor Pressure, psig | 1000 | 300 | 1000 | 1000 |
| Viscosity at 100° C., cSt | 4.104 | 4.397 | 4.415 | 4.524 |
| Viscosity Index | 145 | 158 | 147 | 149 |
| Aromatics, wt % | 0.0086 | | | 0.0109 |
| FIMS, Wt % of Molecules | | | | |
| Paraffins | 88.4 | 79.8 | 89.1 | 89.4 |
| Monocycloparaffins | 11.6 | 21.2 | 10.9 | 10.4 |
| Multicycloparaffins | 0.0 | 0.0 | 0.0 | 0.2 |
| Total | 100.0 | 100.0 | 100.0 | 100.0 |
| API Gravity | 41.78 | | 41.6 | |
| Pour Point, ° C. | −20 | −31 | −12 | −17 |
| Cloud Point, ° C. | −9 | +3 | −8 | −10 |
| Ratio of Mono/Multicycloparaffins | >100 | >100 | >100 | 52 |
| Ratio of Pour Point/Vis100 | −4.87 | −7.05 | −2.72 | −3.76 |
| Base Oil Pour Factor | −7.62 | −7.12 | −7.09 | −6.91 |
| Oxidator BN, Hours | 40.78 | 26.0 | 41.35 | 34.92 |
| Aniline Point, D 611, ° F. | 249.6 | | | 253.2 |
| Noack Volatility, Wt % | 14.43 | | 10.89 | 12.53 |
| CCS Viscosity @−35 C., cP | 1662 | | 2079 | 2090 |

Examples 4, 5, 6, and 7 all had the desired properties of the lubricating base oils of this invention. Examples 4 and 7 had exceptionally high oxidation stabilities, greater than 40 hours. Examples 4 and 7 also had low aniline points, which would provide desirable additive solubility and elastomer compatibility.

Example 8, Comparative Example 9, Example 10, and Example 11

Four lubricating base oils with kinematic viscosities between 6.0 and 7.0 at 100° C. were prepared by hydroisomerizabon dewaxing Fischer-Tropsch wax and fractionating the isomerized oil into different distillate fractions. The properties of these samples are shown in Table IV.

TABLE IV

| Properties | Example 8 | Comparative Example 9* | Example 10 | Example 11 |
|---|---|---|---|---|
| Wax Feed | WAXA | WAXA | WAXA | WAXA |
| Hydroisomerization Temp, ° F. | 676 | 685 | 690 | 681 |
| Hydroisomerization Dewaxing Catalyst | Pt/SAPO-11 | Pt/SSZ-32* | Pt/SAPO-11 | Pt/SAPO-11 |
| Reactor Pressure, psig | 1000 | 1000 | 1000 | 1000 |
| Viscosity at 100° C., cSt | 6.26 | 6.972 | 6.297 | 6.295 |
| Viscosity Index | 158 | 153 | 153 | 154 |
| Aromatics, wt % | | 0.0898 | | 0.0141 |
| FIMS, Wt % of Molecules | | | | |
| Paraffins | 77.0 | 71.4 | 82.5 | 76.8 |
| Monocycloparaffins | 22.6 | 26.4 | 17.5 | 22.1 |
| Multicycloparaffins | 0.4 | 2.2 | 0.0 | 1.1 |
| Total | 100.0 | 100.0 | 100.0 | 100.0 |
| API Gravity | 40.3 | | 40.2 | 40.2 |
| Pour Point, ° C. | −12 | −41 | −23 | −14 |
| Cloud Point, ° C. | −1 | −2 | −6 | −6 |
| Ratio of Mono/Multicycloparaffins | 56.5 | 12.0 | >100 | 20.1 |
| Ratio of Pour Point/Vis100 | −1.92 | −5.89 | −3.65 | −2.22 |
| Base Oil Pour Factor | −4.52 | −3.73 | −4.48 | −4.48 |
| Aniline Point, D 611, ° F. | | | | 263 |
| Noack Volatility, Wt % | 2.3 | 5.5 | 2.8 | 3.19 |
| CCS Vis @−35 C., cP | 5770 | 5993 | 4868 | 5002 |

*not hydrofinished

Examples 8, 10, and 11 are examples of lubricating base oils of this invention. Comparative Example 9 has a low ratio of molecules containing monocycloparaffins to molecules containing multicycloparaffins. In this comparative example, hydroisomerization dewaxing to produce a base oil with very low pour point was done with a yield disadvantage, and likely adversely impacted the ratio of weight percent of molecules containing monocycloparaffins to weight percent of molecules containing multicycloparaffins. Comparative Example 9 also had a higher Noack Volatility than the other oils of similar viscosity. Examples 8, 10, and 11 all had very low CCS VIS at −35° C., well below the amount calculated by 38×Ln(Kinematic Viscosity at 100° C.)$^{2.8}$.

Example 12, Comparative Example 13, Example 14, and Example 15

Four lubricating base oils with kinematic viscosities between 7.0 and 8.0 cSt at 100° C. were prepared by hydroisomerization dewaxing Fischer-Tropsch wax and fractionating the isomerized oil into different distillate fractions. The properties of these samples are shown in Table V.

TABLE V

| Properties | Example 12 | Comparative Example 13 | Example 14 | Example 15 |
|---|---|---|---|---|
| Wax Feed | WAXA | WAXA | WAXA | WAXC |
| Hydroisomerization Temp, ° F. | 679 | 685 | 674 | 694 |
| Hydroisomerization Dewaxing Catalyst | Pt/SSZ-32 | Pt/SSZ-32 | Pt/SSZ-32 | Pt/SAPO-11 |
| Reactor Pressure, psig | 1000 | 1000 | 1000 | 1000 |
| Viscosity at 100° C., cSt | 7.182 | 7.023 | 7.468 | 7.953 |
| Viscosity Index | 159 | 155 | 170 | 165 |
| Aromatics, wt % | 0.0056 | 0.0037 | 0.0093 | |
| FIMS, Wt % of Molecules | | | | |
| Paraffins | 71.3 | 69.0 | 81.4 | 87.2 |
| Monocycloparaffins | 27.1 | 28.4 | 18.6 | 12.6 |
| Multicycloparaffins | 1.6 | 2.6 | 0.0 | 0.2 |
| Total | 100.0 | 100.0 | 100.0 | 100.0 |
| API Gravity | | | | 39.62 |
| Pour Point, ° C. | −27 | −33 | −9 | −12 |
| Cloud Point, ° C. | +6 | −4 | +10 | +13 |
| Ratio of Mono/Multicycloparaffins | 16.9 | 10.9 | >100 | 61 |
| Ratio of Pour Point/Vis100 | −3.76 | −4.70 | −1.21 | −1.51 |
| Base Oil Pour Factor | −3.51 | −3.67 | −3.22 | −2.76 |
| Noack Volatility | 4.9 | 5.4 | 4.3 | 2.72 |
| CCS Vis @ −35 C., cP | 5873 | 5966 | 7379 | 13627 |

Example 14 is a lubricating base oil of this invention with a particularly high viscosity index, greater than 28×Ln(Vis 100)+110, and a particularly low CCS VIS at −35° C. Examples 12 and 15 also met the properties of this invention, although Example 15 did not meet the more preferred range of CCS viscosity at −35° C. (less than an amount calculated from the equation: CCS VIS(−35° C.)=38×(Kinematic Viscosity at 100° C.)$^3$. Comparative Example 13 did not meet the properties of this invention due to a low ratio of weight percent of molecules containing monocycloparaffins and weight percent of molecules containing mulficycloparaffins. This may have occurred as a result of hydroisomerization dewaxing to a lower pour point in this example, which resulted in the formation of more multicycloparaffins.

Example 16

A lubricating base oil with a kinematic viscosity between 9.5 and 10.0 cSt at 100° C. was prepared by hydroisomerization dewaxing Fischer-Tropsch wax and fractionating the isomerized oil into different distillate fractions. The properties of this sample are shown in Table VI.

TABLE VI

| Properties | Example 16 |
|---|---|
| Wax Feed | WAXA |
| Hydroisomerization Temp, ° F. | 669 |
| Hydroisomerization Dewaxing Catalyst | Pt/SAPO-11 |
| Reactor Pressure, psig | 1000 |
| Viscosity at 100° C., cSt | 9.679 |
| Viscosity Index | 168 |
| FIMS, Wt % of Molecules | |
| Paraffins | 84.4 |
| Monocycloparaffins | 14.7 |
| Multicycloparaffins | 0.9 |
| Total | 100.0 |
| Pour Point, ° C. | +1 |
| Cloud Point, ° C. | +26 |
| Ratio of Mono/Multicycloparaffins | 16.3 |
| Ratio of Pour Point/Vis100 | 0.10 |
| Base Oil Pour Factor | −1.32 |
| Oxidator BN, hours | 34.64 |
| Aniline Point, D611, ° F. | 280.3 |
| Noack Volatility | 0.9 |

Example 16 met the properties of the lubricating base oil of this invention, including high oxidation stability, low aniline point, and low Noack volatility. The Noack Volatility is less than the amount calculated from the equation:

$$\text{Noack Volatility, Wt \%}=900\times(\text{Kinematic Viscosity at } 100^\circ\text{ C.})^{-2.8}.$$

Comparative Example 17

A hydrotreated Fischer-Tropsch wax (Table VII) was isomerized over a Pt/SSZ-32 catalyst which contained 0.3% Pt and 35% Catapal alumina binder. Run conditions were 560° F. hydroisomerization temperature, 1.0 LHSV, 300 psig reactor pressure, and a once-through hydrogen rate of 6 MSCF/bbl. The reactor effluent passed directly to a second reactor, also at 300 psig, which contained a PtPd on silica-alumina hydrofinishing catalyst. Conditions in that reactor were a temperature of 450° F. and LHSV of 1.0. Conversion and yields, as well as the properties of the hydroisomerized stripper bottoms are given in Table VIII.

TABLE VII

| Inspections of Hydrotreated Fischer-Tropsch Wax | |
|---|---|
| Gravity, API | 40.3 |
| Nitrogen, ppm | 1.6 |
| Sulfur, ppm | 2 |
| Sim. Dist., Wt %, ° F. | |
| IBP/5 | 512/591 |
| 10/30 | 637/708 |
| 50 | 764 |
| 70/90 | 827/911 |
| 95/FBP | 941/1047 |

TABLE VIII

| Isomerization of FT Wax over Pt/SSZ-32 at 560° F., 1 LHSV, 300 psig, and 6 MSCF/bbl H2 | |
|---|---|
| Conversion <650° F., Wt % | 15.9 |
| Conversion <700° F., Wt % | 14.1 |
| Yields, Wt % | |
| C1-C2 | 0.11 |
| C3-C4 | 1.44 |
| C5-180° F. | 1.89 |
| 180-290° F. | 2.13 |
| 290-650° F. | 21.62 |
| 650° F.+ | 73.19 |
| Stripper Bottoms: | |
| Yield, Wt % of Feed | 75.9 |
| Sim. Dist., LV %, ° F. | |
| IBP/5 | 588/662 |
| 30/50 | 779/838 |
| 95/99 | 1070/1142 |
| Pour Point, ° C. | +25 |

The stripper bottoms were solvent dewaxed using MEK/toluene at −15° C. The wax content was 33.9 wt %, and oil yield was 65.7 wt %. The solvent dewaxed 650° F.+ oil yield, based on feed to the process, was 49.9 wt %. Inspections on this lubricating base oil are given below in Table IX.

TABLE IX

| Inspections of Hydroisomerized FT Wax after Solvent Dewaxing | Comparative Example 17 |
|---|---|
| Viscosity Index | 175 |
| Viscosity at 100° C., cSt | 3.776 |
| Pour Point, ° C. | −18 |
| Cloud Point, ° C. | −5 |
| Sim. Dist., LV %, ° F. | |
| IBP/5 | 608/652 |
| 10/30 | 670/718 |
| 50 | 775 |
| 70/90 | 890/953 |
| 95/FBP | 1004/1116 |
| FIMS, Wt % of Molecules | |
| Paraffins | 96 |
| Monocycloparaffins | 4 |
| Multicycloparaffins | 0 |
| Total | 100 |
| Oxidator BN, Hours | 31.87 |
| Ratio of Mono/Multicycloparaffins | >100 |
| Ratio of Pour Point/Vis 100 | −4.77 |
| Base Oil Pour Factor | −8.23 |

Comparative Example 17 demonstrates that mild hydroisomerization dewaxing and subsequent solvent dewaxing produced a very low weight percent of all molecules with at least one cycloparaffin function. The hydroisomerization temperature was well below the desired range of about 600° F. to about 750° F. Although the Oxidator BN and the viscosity index of this oil was very high it would not have the preferred additive solubility and elastomer compatibility properties associated with the lubricating base oils of this invention with higher weight percents of all molecules with at least one cycloparaffin function. This example also points out that the Base Oil Pour Factor, although often associated with oils that meet the properties of the lubricating base oils of this invention can not be used independently of the other criteria (weight percent of all molecules with at least one cycloparaffin function and ratio of weight percent of molecules containing monocycloparaffins to weight percent of molecules containing multicycloparaffins, or high weight percent of molecules containing monocycloparaffins and low weight percent of molecules containing multicycloparaffins) to characterize the lubricating base oils of this invention.

Comparative Example 18

An n-C36 feed (purchased from Aldrich) was isomerized over a Pt/SSZ-32 catalyst which contained 0.3% Pt and 35% Catapal alumina binder. Run conditions were hydroisomerization temperature of 580° F., 1.0 LHSV, 1000 psig reactor pressure, and a once-through hydrogen to feed ratio of 7 MSCF/bbl. The reactor effluent passed directly to a second reactor, also at 1000 psig, which contained a Pt/Pd on silica-alumina hydrofinishing catalyst. Conditions in that reactor were a temperature of 450° F. and LHSV of 1.0. Conversion and yields were as shown in Table X:

TABLE X

| | |
|---|---|
| Conversion <650° F., Wt % | 32.2 |
| Conversion <700° F., Wt % | 34.4 |
| Yields, Wt % | |
| C1-C2 | 0.45 |
| C3-C4 | 5.16 |
| C5-180° F. | 6.22 |
| 180-350° F. | 7.40 |
| 350-650° F. | 13.23 |
| 650° F.+ | 68.09 |

The hydroisomerized stripper bottoms from had a pour point of +20° C. The stripper bottoms were solvent dewaxed using MEK/toluene at −15° C. The wax content was 31.5 wt %, and oil yield was 68.2 wt %. The solvent dewaxed 650° F.+ oil yield, based on feed to the process, was 45.4 wt %. Inspections on this oil are summarized in Table XI.

Comparative Example 19

A pilot reactor run produced a lubricating base oil made from n-C28 feed (purchased from Aldrich) using a Pt/SSZ-32 catalyst (0.3 wt % Pt) bound with 35 wt % Catapal alumina. The run was at 1000 psig, 0.8 LHSV, and 7 MSCF/bbl once-through hydrogen to feed ratio. Reactor hydroisomerization temperature was 575° F. The effluent from the reactor was subsequently passed over a Pt—Pd/SiO2-Al2O3 hydrofinishing catalyst at 450° F. and, other than temperature, the same conditions were used as in the isomerization reactor. The yield of 600° F.+ product was 71.5 wt %. The conversion of the wax to 600° F.− boiling range material was 28.5 wt %. The conversion below 700° F. was 33.6 wt %. The bottoms fraction from the run (75.2 wt %) was cut at 743° F. to give 89.2 wt % bottoms (67.1 wt % on the whole feed).

The hydroisomerized stripper bottoms had a pour point of +3° C. These bottoms were then solvent dewaxed at −15° C. to give 84.2 wt % solvent dewaxed oil (56.5 wt % on the whole feed), and 15.7 wt % wax. Inspections of the oil are shown in Table XI.

TABLE XI

| Properties | Comparative Example 18 | Comparative Example 19 |
|---|---|---|
| Wax Feed | n-C36 | n-C28 |
| Viscosity at 100° C., cSt | 5.488 | 3.477 |
| Viscosity Index | 182 | 165 |
| FIMS, Wt % of Molecules | | |
| Paraffins | 98.3 | 100 |
| Monocycloparaffins | 1.7 | 0.0 |
| Multicycloparaffins | 0.0 | 0.0 |
| Total | 100.0 | 100.0 |
| Pour Point, ° C. | −9 | −15 |
| Aniline Point, D 611, ° F. | 261.9 | 245.1 |

Neither Comparative Example 18 nor Comparative Example 19 met the properties of this invention as they had very low weight percents of all molecules with at least one cycloparaffin function Neither of these base oils with low cycloparaffin content had aniline points as low as the base oils of this invention. Notably, they were both greater than 36×Ln(Kinematic Viscosity at 100° C.)+200, in ° F. These oils would be expected to have lower additive solubility and less desirable elastomer compatibility than the base oils of this invention. The hydroisomerization temperature was lower than the preferred range of about 600° F. to 750° F., which likely contributed to the lower amounts of cycloparaffins in both of these comparative examples.

Comparative Example 20 and Comparative Example 21

Two commercial Group III lubricating base oils were prepared using a waxy petroleum feed. The waxy petroleum feed had greater than about 30 ppm total combined nitrogen and sulfur and had a weight percent oxygen less than about 0.1. The feed was dewaxed by hydroisomerization dewaxing using Pt/SSZ-32 at a hydroisomerizafion dewaxing temperature between about 650° F. (343° C.) and about 725° F. (385° C.). They were both hydrofinished. The properties of these two samples are shown in Table XII.

TABLE XII

| Properties | Comparative Example 20 | Comparative Example 21 |
|---|---|---|
| Description | Chevron UCBO 4R | Chevron UCBO 7R |
| Hydroisomerization Temp, ° F. | 600-750° F. | 600-750° F. |
| Hydroisomerization Dewaxing Catalyst | Pt/SSZ-32 | Pt/SSZ-32 |
| Viscosity at 100° C., cSt | 4.18 | 6.97 |
| Viscosity Index | 130 | 137 |
| Aromatics, wt % | 0.022 | 0.035 |

TABLE XII-continued

| Properties | Comparative Example 20 | Comparative Example 21 |
|---|---|---|
| FIMS, Wt % of Molecules | | |
| Paraffins | 24.6 | 24.8 |
| Monocycloparaffins | 43.6 | 51.2 |
| Multicycloparaffins | 31.8 | 24.0 |
| Total | 100.0 | 100.0 |
| API Gravity | 39.1 | 37.0 |
| Pour Point, ° C. | −18 | −18 |
| Cloud Point, ° C. | −14 | 5 |
| Ratio of Mono/Multicycloparaffins | 1.4 | 2.1 |
| Aniline Point, D 611, ° F. | 242.1 | 260.2 |

These two comparative examples demonstrate how lubricating base oils made with conventional waxy petroleum feeds, where the feeds contain high levels of sulfur and nitrogen, have high weight percents of all molecules with at least one cydoparaffin function. They also have low weight percents of all molecules with at least one aromatic function. However, they both have less desired very low ratios of weight percent of molecules containing monocycloparaffins to weight percent of molecules containing multicycloparaffins, much below the desired ratio of greater than 15 of the lubricating base oils of this invention. As a result, although they have aniline points similar to the lubricating base oils of this invention, they have lower viscosity indexes, below the desired level defined by the equation: VI=28×Ln (Kinematic Viscosity at 100° C.)+95.

Examples 22, 23 and 24

Three Fischer-Tropsch derived lubricating base oils were made out of a broad boiling Co-based Fischer-Tropsch wax having a weight ratio of molecules having at least 60 or more carbon atoms and molecules having at least 30 carbon atoms less than 0.10, and a T90 boiling point between 660° F. (349° C.) and 1200° F. (649° C.). The lubricating base oils were made under varying hydrogen to feed ratios during hydroisomerizabon dewaxing. The fractions of the products boiling above about 615° F. were collected and analyzed. The inspections on these three lubricating base oils are summarized below in Table XIII.

TABLE XIII

| | Example 22 | Example 23 | Example 24 |
|---|---|---|---|
| Hydroisomerization Temp, ° F. | 600-750° F. | 600-750° F. | 600-750° F. |
| Hydroisomerization Dewaxing Catalyst | Pt/SSZ-32 | Pt/SSZ-32 | Pt/SAPO-11 |
| Hydrogen to Feed Ratio, MSCF/bbl | 5.0 | 2.3 | 2.0 |
| Viscosity @ 100 C., cSt | 5.3 | 5.338 | 4.856 |
| VI | NA | 176 | 151 |
| Pour Point, C. | −29 | −27 | −32 |
| Aromatics by HPLC-UV, wt % | 0.0043 | 0.0209 | 0.0038 |
| FIMS Analysis, wt % | | | |
| Alkanes | 84.2 | 83.2 | 74.2 |
| 1-Unsaturation | 15.8 | 16.4 | 25.0 |
| 2-Unsaturation | 0 | 0.2 | 0.8 |
| 3-Unsaturation | 0 | 0.1 | 0.0 |
| 4-Unsaturation | 0 | 0.0 | 0.0 |
| 5-Unsaturation | 0 | 0.0 | 0.0 |
| 6-Unsaturation | 0 | 0.0 | 0.0 |

TABLE XIII-continued

| | Example 22 | Example 23 | Example 24 |
|---|---|---|---|
| % Olefins by Proton NMR | 0.00 | 0.00 | 0.89 |
| Wt % Molecules with Monocycloparaffinic Functionality | 15.80 | 16.40 | 24.11 |
| Wt % Molecules with Multicycloparaffinic Functionality | 0.00 | 0.28 | 0.80 |
| Ratio of Monocycloparaffins/Multicycloparaffins | >100 | 58.6 | 30.1 |

These results demonstrate how increasing the hydrogen to feed rato during hydroisomerization dewaxing reduced the level of molecules having multicycloparaffinic functionality. At a hydrogen to feed ratio of 5.0 MSCF/bbl the lubricating base oil that was produced had no molecules with multicycloparaffinic functionality, but retained greater than 10 wt % total molecules with cycloparaffinic functionality.

Comparative Examples 25, 26, 27, and 28

Three lubricating base oil samples were prepared by hydroisomerization dewaxing a hydrotreated Co-based Fischer Tropsch wax in a relatively large pilot plant run. The hydrotreated Fischer-Tropsch wax had a T10 boiling point by ASTM D 6352 of 672° F. and a T90 boiling point by ASTM D 6352 of 1032° F. The hydrotreated Co-based Fischer-Tropsch wax was hydroisomerized, hydrofinished, and vacuum distilled into three different distillate fractions that were different lubricating base oil grades.

Hydroisomerization conditions included a LHSV feed rate of about 1, about 325-375 psig pressure, and a relatively low hydrogen flow rate. The hydrofinishing was done under conditions selected to reduce the aromatics to below 0.05 wt % and the olefins to less than 0.01 wt %, without substantially hydrocracking the feed.

The relevant test data on these three different test grades (Extra Light, Light and Medium) of base oil are summarized below in Table XIV:

TABLE XIV

| | Comparative Example 25 | Comparative Example 26 | Comparative Example 27 |
|---|---|---|---|
| Base Oil Grade | XL | L | M |
| Hydroisomerization Temp, ° F. | 650-700 | 650-700 | 650-700 |
| Hydroisomerization Dewaxing Catalyst | Pt/SAPO-11 | Pt/SAPO-11 | Pt/SAPO-11 |
| Hydrogen to Feed Ratio, MSCF/bbl | 2.5-2.6 | 2.5-2.6 | 2.5-2.6 |
| Kinematic Viscosity @ 100° C., cSt | 2.653 | 4.081 | 7.932 |
| Viscosity Index | 128 | 147 | 162 |
| Aromatics by HPLC-UV, wt % | <0.05 | <0.05 | <0.05 |
| Olefins by Proton NMR, wt % | 0.0 | 0.0 | 0.0 |
| FIMS Data | | | |
| Wt % molecules with monocycloparaffinic functionality | 13.3 | 17.7 | 28.2 |
| Wt % molecules with multicycloparaffinic functionality | 1.0 | 1.4 | 3.5 |
| Mono-/Multi-cycloparaffins | 13.3 | 12.6 | 8.1 |

Note that none of the comparative examples 25, 26 or 27 had the preferred ratio of weight percent molecules containing monocycloparaffins to weight percent of molecules containing multicycloparaffins greater than 15. The weight percent molecules with multicycloparaffinic functionality would have been reduced if the hydroisomerization dewaxing was done using a higher hydrogen to feed rato.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. A method for producing a lubricating base oil having greater than 10 weight percent total molecules with cycloparaffinic functionality and less than 0.5 weight percent of molecules with multicycloparaffinic functionality, comprising:

a. selecting a Fischer-Tropsch derived wax having a weight ratio of molecules having at least 60 or more carbon atoms and molecules having at least 30 carbon atoms of 0.01 or less, wherein the Fischer-Tropsch derived wax has a difference between the T90 and T10 boiling points of at least 171° F. (95° C.); and b. hydroisomerization dewaxing the Fischer-Tropsch derived wax under a set of conditions comprising a hydrogen to feed ratio from about 712.4 to about 3562 liter $H_2$/liter feed (about 4 to about 20 MSCF/bbl) to produce the lubricating base oil, with the lubricating base oil having a viscosity index greater than an amount defined by the equation: VI=28×Ln(Kinematic Viscosity at 100° C.)+95.

2. The method of claim 1, wherein the hydrogen to feed ratio is from about 801.45 to about 1781 liter $H_2$/liter oil (about 4.5 to about 10 MSCF/bbl).

3. The method of claim 2, wherein the hydrogen to feed ratio is from about 890.5 to about 1424.8 liter $H_2$/liter oil (about 5.0 to about 8.0 MSCF/bbl).

4. The method of claim 1, wherein the lubricating base oil has a viscosity index greater than an amount defined by the equation: VI=28×Ln(Kinematic Viscosity at 100° C.)+105.

5. The method of claim 1, wherein the lubricating base oil has less than 0.5 wt % olefins by proton NMR.

6. The method of claim 1, wherein the lubricating base oil has a kinematic viscosity at 100° C. between 6.0 and 10.0 cSt.

7. The method of claim 1, wherein the lubricating base oil has a kinematic viscosity at 100° C. between 2.0 and 5.0 cSt.

8. The method of claim 1, wherein the lubricating base oil has an Oxidator BN greater than 25 hours.

9. The method of claim 1, wherein the hydroisomerization dewaxing is done using a catalyst comprising a shape selective intermediate pore size molecular sieve.

10. The method of claim 1, wherein the set of conditions comprises a temperature of 260° C. to about 413° C.

11. The method of claim 1, wherein the set of conditions comprises a total pressure of 15 to 3000 psig.

12. The method of claim 1, wherein hydrogen is separated from a product of the hydroisomerization and recycled to an isomerization zone where the hydroisomerization is performed.

13. The method of claim 1, wherein the Fischer-Tropsch derived wax has greater than about 75 mass percent normal paraffin.

14. The method of claim 1, wherein the Fischer-Tropsch derived wax has less than about 30 ppm total combined nitrogen and sulfur.

15. The method of claim 1, wherein the Fischer-Tropsch derived wax has a T90 boiling point between 660° F. (349° C.) and 1200° F. (649° C.).

16. A method for producing a lubricating base oil, consisting essentially of;

a. selecting a Fischer-Tropsch derived wax having a weight ratio of molecules having at least 60 or more carbon atoms and molecules having at least 30 carbon atoms of 0.01 or less, wherein the Fischer-Tropsch derived wax has a difference between the T90 and T10 boiling points of at least 171° F. (95° C.); and b. hydro isomerization dewaxing the Fischer-Tropsch derived wax under a set of conditions comprising a hydrogen to feed ratio from about 712.4 to about 3562 liter $H_2$/liter feed (about 4 to about 20 MSCF/bbl) to produce the lubricating base oil; wherein the lubricating base oil has a kinematic viscosity at 100° C. between 2 and about 3.3 cSt, a weight percent of all molecules with at least one cycloparaffin function greater than 3 times the kinematic viscosity at 100° C., and a weight percent of molecules with muticycloparaffinic functionality less than 0.7.

17. The method of claim 16, wherein the weight percent of molecules with multicycloparaffinic functionality is less than 0.5.

18. The method of claim 17, wherein the weight percent of molecules with multicycloparaffinic functionality is 0.2 or less.

19. The method of claim 16, wherein the lubricating base oil has a viscosity index greater than an amount defined by the equation: VI=28×Ln(Kinematic Viscosity at 100° C.)+95.

* * * * *